United States Patent [19]

Stuebinger

[11] 4,003,280

[45] Jan. 18, 1977

[54] DRIVE DEVICE FOR WEB CROSSCUTTING APPARATUS

[75] Inventor: Walter Stuebinger, Nuernberg, Germany

[73] Assignee: BHS-Bayerische Berg Hutten-und Salzwerke Aktiengesellschaft, Munich, Germany

[22] Filed: Sept. 19, 1975

[21] Appl. No.: 614,846

[30] Foreign Application Priority Data

Sept. 30, 1974 Germany ..... 2446723

[52] U.S. Cl. ..... 83/324; 83/593

[51] Int. Cl.[2] ..... B26D 25/04; B26D 1/56

[58] Field of Search ..... 83/324, 593

[56] References Cited

UNITED STATES PATENTS

| | | | |
|---|---|---|---|
| 2,372,780 | 4/1945 | Hess | 83/593 |
| 2,764,238 | 9/1956 | Rusinoff et al. | 83/324 |
| 3,015,978 | 1/1962 | Innocenti | 83/324 |
| 3,202,026 | 8/1965 | Buhl | 83/324 X |
| 3,410,163 | 11/1968 | Taylor | 83/324 X |

*Primary Examiner*—Travis S. McGehee
*Attorney, Agent, or Firm*—Silverman & Cass, Ltd.

[57] ABSTRACT

Apparatus for driving a web crosscutting roller with knife blade. A variable speed motor drives the roller which also is of variable speed. A control device is operable on the motor to effect selective change of the rotative speed thereof. A spring is connected to the roller to alternatively impart retardation or acceleration energy to the roller during a revolution thereof by alternate tensioning and release of the spring.

5 Claims, 2 Drawing Figures

Fig. 1
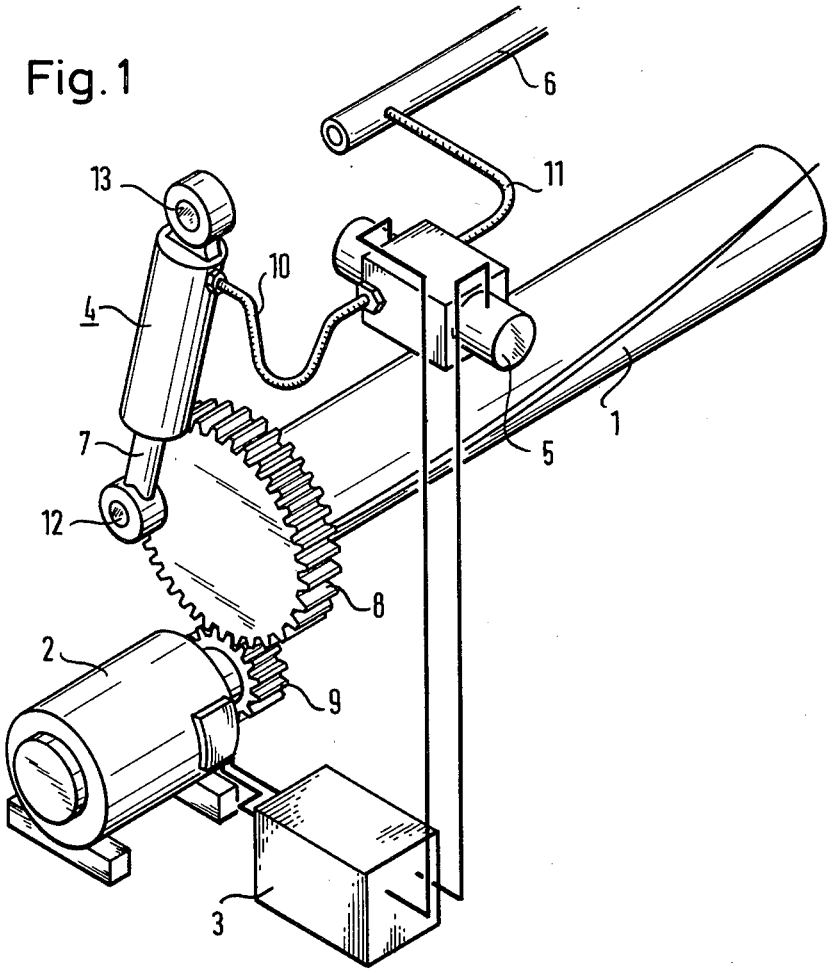
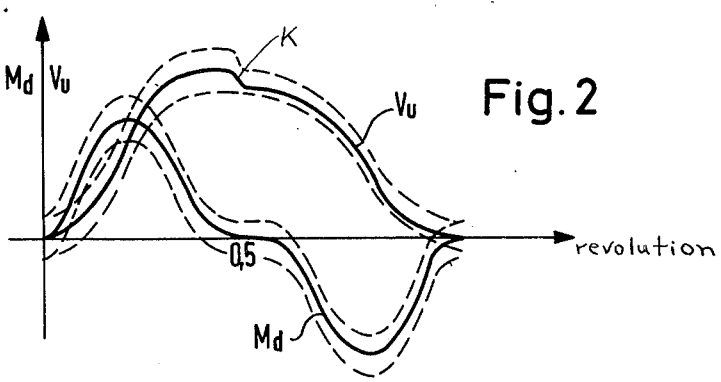
Fig. 2

DRIVE DEVICE FOR WEB CROSSCUTTING APPARATUS

BACKGROUND OF THE INVENTION

This invention relates generally to a drive device for a web crosscutting apparatus in which a continuously moving sheet of material, such as corrugated cardboard, is to be cut; more specifically, the invention relates to such a device having an electrical drive motor, the number of revolutions of which is variable, and including a knife driven by the motor to cut the sheet; the moving speed of said knife is variable in order to cut a portion of the sheet.

Machines for cutting a continuously moving sheet of material require a drive device having a periodically variable number of revolutions in order to produce different length portions of the sheet. At the time of cutting, the circumferential speed of the knife is required to be equal to the speed at which the sheet of material passes in contact with the knife.

Such a drive device is disclosed in U.S. Pat. No. 3,680,616. In the patent, a knife running crosswise with respect to a moving web is raised by the action of two cam-type gearings. The movement of the knife is effected during cutting of the web in synchronization with the movement of the web; the drive velocity of the two cam-type gearings or transmissions is maintained constant. The result is that only one fixed length of the web may be cut in the device of the patent. In order to change the length of the web to be cut, the cam plates of the device must first be changed, and this requires undesirable rebuilding of the device.

SUMMARY OF THE INVENTION

The present invention is concerned with the problem of providing a drive device which has a simple construction, is easily changeable to enable cutting of different sheet lengths, and saves energy.

The invention achieves the desired solution to these problems by providing an electrical control device which is capable of changing the rotative speed of the drive motor during a complete revolution thereof. The driven knife of the invention is designed to rotate and the drive means for the knife is connected with a spring which provides the energy for retarding or accelerating the speed of the rotating knife during a revolution thereof by tensioning or releasing the knife at each rotation. Accordingly, the invention is such that with each revolution of the drive device, a spring which supplies the energy for retardation and acceleration of the knife is activated; the differential energy, such as that resulting from friction and cutting forces, is supplied by the drive motor having electronic control.

The device of the invention is such that the drive motor requires only a fraction of the capacity which is necessary for the accelerating and retarding operations of prior devices. Moreover, by operating the electrical control device, the drive device can easily be changed over to accommodate sheet portions of different dimensions. A rotating knife furthermore simplifies the construction of the drive device herein.

The device of the invention also is such that a movable portion of the spring can be connected with the crosscutting apparatus; with this modification, a gear unit may be arranged between the drive motor and the crosscutting apparatus, and the movable portion of the spring may be connected with the gear wheel of the crosscutting apparatus. This structure provides a simple but effective construction.

Alternatively, the spring may be designed as a pneumatic spring in which the control arrangement for the drive motor simultaneously controls the pneumatic spring.

In a further alternate form of the invention, the piston rod of the pneumatic spring is connected with the gear wheel of the crosscutting apparatus to form a crank slide oscillator; this form of the invention also provides a simple mechanical construction.

In a still further form of the invention, the cylinder volume of the pneumatic spring may be variable and thereby the characteristics of the spring may advantageously be changed in accordance with changes of the speed of the apparatus.

Other advantages of the invention will occur to those skilled in the art from the ensuing description.

BRIEF DESCRIPTION OF THE DRAWING

FIG. 1 a schematic perspective view of the drive device constructed in accordance with the invention; and FIG. 2 is a graph showing the acceleration and velocity relationships of the device during one revolution.

DESCRIPTION OF THE PREFERRED EMBODIMENTS

As illustrated in FIG. 1, there is provided a rotatable cutting roller 1, operable as a crosscutter for a web or other sheet of material (not shown). The roller 1 is driven by a drive motor 2. A pinion 9 on the drive motor 2 meshes with the gear wheel 8 of the cutting roller 1 to effect the drive. A pneumatic spring 4 is connected to gear wheel 8 on one front side thereof by a pin 12 formed on the piston rod 7. Part 13 of the pneumatic spring 4 is firmly secured on the housing of the machine in which the apparatus is mounted (not shown).

The cylinder space of the pneumatic spring 4 is connected with an air supply 6 by conduits 10 and 11. A solenoid valve 5 is disposed between conduits 10 and 11. The solenoid valve 5 is controlled by an electronic control device 3 which simultaneously controls the drive motor 2. The cutting roller 1 is caused to rotate at slow speed by operation of the drive motor 2. The desired speed variations are produced by the electronic control device 3.

Since during slow speed rotation of roller 1 accelerations and retardations thereof are not great, the pneumatic cylinder 4 is very nearly depressurized. With an increasing number of revolutions of the roller as the web to be cut passes therebelow at increasing speed, the control device 3 registers an increase in the required torque for motor 2. The control device thereby causes solenoid valve 5 to open to let air pass from the supply 6 into the cylinder space of the pneumatic cylinder 4 through conduits 10 and 11. The subsequent operation is then as follows. Assuming the pin 12 to be at a first location at the upper dead-center position of gear 8 (possibly even stopped), the pneumatic piston 4 is tensioned with high compression. Subsequently, the drive motor 2 rotates gear 8 to move pin 12 beyond the upper dead-center position; the air in the cylinder 4 then begins to de-compress to effect acceleration of the piston rod 7 and thereby to impart increasing momentum to the gear wheel 8.

In the bottom dead-center position of pin 12, i.e. with the piston rod 7 completely withdrawn from the cylinder space of the spring 4, the maximum speed of the device is achieved. This speed may be corrected, within certain limits, by the controlled drive motor 2. When the gear wheel 8 continues to rotate beyond the bottom dead-center position of pin 12, the air in the cylinder 4 is again compressed and thereby retards the drive speed of the cutting roller 1. The drive motor 2 then adds or supplies the differential energy which has been lost, for instance, in operation of the cutting roller 1 to cut the web. During continued revolution of gear 8, the upper dead-center position of pin 12 again is reached and the speed of the device is reduced in such a way that the desired expiration of time is achieved. In cases where very long intervals of time are desired, the drive motor is stopped in the upper dead-center position.

The course of movement described above is illustrated in FIG. 2. The circumferential speed $v_u$ increases and then decreases again; a small jump in speed K results because of the use of the cutting energy of the roller 1. The broken lines represent the possibility of correction by the drive motor 2. FIG. 2 also shows a corresponding torque curve $M_d$ which results because of the effect of the pneumatic spring 4, the solenoid valve 5, the electronic control device 3 and the drive motor 2. If the maximum speed of the device is changed, the characteristics of the spring 4 must also be changed because the drive motor 2 can effect slight corrections only. The spring characteristics preferably are varied by supplying air to the pneumatic cylinder 4 so that the spring becomes more tensile and a higher speed results, or by decreasing the air volume in the pneumatic cylinder 4 whereby the spring becomes less tensile and a lower speed results. The control of this action can take place, for example, by varying the number of revolutions and the torque rating of the drive motor 2.

Adjustment of the location of piston pin 12 is another manner in which the influence of the spring may be changed. This can be accomplished by mechanical means. Such adjustment by changing the location of pin 12 would be appropriate if a steel spring were used in place of the pneumatic spring 4; however, the force constant of such a steel spring can be changed only with difficulty.

In summary, it is possible to achieve a changeable angular speed of the roller 1 during one revolution thereof by means of a construction in which a spring 4 in the form of an crankslide oscillator is connected with the gear wheel 8 of the cutting roller of the crosscutting device by way of a piston rod 7, and a crankshaft pin 12, and by control through an electronically controlled drive motor 2 connected electrically therewith, all without the need of excessive energy for effective acceleration or retardation of the device.

I claim:

1. An apparatus for driving a device to crosscut a continuously moving sheet of material, particularly corrugated cardboard, comprising:

a drive motor connected with a rotary cutting roller;

a control device operable on said motor during a revolution of the roller to effect a selectable sectional length of the material and a synchronous cutting speed between the roller and the material; and an air cylinder coupled to said roller and said motor and having an enclosed air volume to take up retardation energy by compression of the air volume and yield it by decompression of the air volume, thereby relieving the drive motor.

2. An apparatus as claimed in claim 1 in which a gear unit is arranged between the drive motor and the roller, a piston rod of the air cylinder being connected to the gear by way of a crank-slide oscillator.

3. An apparatus as claimed in claim 1 in which the control device is also operable on said air cylinder and in response to variations in the speed of the sheet of material, the control device of the drive motor simultaneously controls the air volume of the cylinder.

4. An apparatus as claimed in claim 1 in which the volume of the air cylinder is variable.

5. An apparatus as claimed in claim 4 in which the variable air cylinder volume is controlled by the drive motor.

* * * * *